US009234691B2

(12) United States Patent
Black et al.

(10) Patent No.: US 9,234,691 B2
(45) Date of Patent: Jan. 12, 2016

(54) METHOD AND APPARATUS FOR CONTROLLING TEMPERATURE IN A CRYOCOOLED CRYOSTAT USING STATIC AND MOVING GAS

(75) Inventors: Randall Black, San Diego, CA (US); Dinesh Martien, San Diego, CA (US); William Neils, San Diego, CA (US); Jost Diederichs, Poway, CA (US)

(73) Assignee: Quantum Design International, Inc., San Diego, CA (US)

( * ) Notice: Subject to any disclaimer, the term of this patent is extended or adjusted under 35 U.S.C. 154(b) by 1131 days.

(21) Appl. No.: 12/722,128

(22) Filed: Mar. 11, 2010

(65) Prior Publication Data

US 2011/0219785 A1 Sep. 15, 2011

(51) Int. Cl.
*F25B 21/00* (2006.01)
*F25B 25/00* (2006.01)
(Continued)

(52) U.S. Cl.
CPC ..... *F25D 19/006* (2013.01); *F17C 3/085* (2013.01); *F17C 13/006* (2013.01); *F17C 13/007* (2013.01); *F25B 9/145* (2013.01); *F17C 2223/043* (2013.01); *F17C 2227/0383* (2013.01); *F17C 2270/0509* (2013.01);
(Continued)

(58) Field of Classification Search
CPC ..... F17C 3/085; F17C 2227/0327; F17C 2227/0365
USPC ..... 62/51.1, 610, 100, 608
See application file for complete search history.

(56) References Cited

U.S. PATENT DOCUMENTS 4,791,788 A * 12/1988 Simmonds ..... F17C 13/026 62/49.1
4,848,093 A 7/1989 Simmonds et al.
(Continued)

FOREIGN PATENT DOCUMENTS

DE 102006046688 B3 * 1/2008
GB 2318176 A 4/1998
GB 2379496 B 5/2004

OTHER PUBLICATIONS

L. E. Delong et al., "Continuously Operating 4He Evaporation Refrigerator," Rev. Sci. Instrum., Jan. 1971 (pp. 147-150), vol. 42, Issue 1, American Institute of Physics.
(Continued)

*Primary Examiner* — John Frank Pettitt, III
*Assistant Examiner* — Tareq Alosh
(74) *Attorney, Agent, or Firm* — Stetina Brunda Garred & Brucker

(57) ABSTRACT

A cryostat for providing temperature regulation, one purpose being measuring physical properties of materials, the cryostat employing a superconducting magnet assembly for generating variable magnetic field in the sample space and a cryogenic cooler for cooling the sample space. The cryogenic cooler chamber configuration provides for efficient heat exchange between different stages of the cryogenic cooler without the need for physical heat links. This construction enables selective delivery of cooling power from the cryogenic cooler to the desired areas within the cryostat without using flexible physical thermal links. A counter flow exchanger and ambient temperature valves facilitate efficient use of the cryogenic cooler stages. The removal of large heat load generated by the superconducting magnet while operating in the sweeping mode is achieved, in part, by employing a solid plate thermal coupling element between the cryogenic cooler chamber and the magnet assembly.

22 Claims, 4 Drawing Sheets

(51) Int. Cl.

| | |
|---|---|
| ***B01D 8/00*** | (2006.01) |
| ***F25B 29/00*** | (2006.01) |
| ***F25B 45/00*** | (2006.01) |
| ***F25D 19/00*** | (2006.01) |
| ***F17C 3/08*** | (2006.01) |
| ***F17C 13/00*** | (2006.01) |
| ***F25B 9/14*** | (2006.01) |
| *F25B 9/10* | (2006.01) |

(52) U.S. Cl.
CPC ..... *F17C 2270/0527* (2013.01); *F25B 9/10* (2013.01); *F25B 2400/17* (2013.01)

(56) References Cited

U.S. PATENT DOCUMENTS

| | | | | |
|---|---|---|---|---|
| 5,220,800 | A * | 6/1993 | Muller | G01R 33/3815 335/216 |
| 5,410,286 | A * | 4/1995 | Herd et al. | 335/216 |
| 5,613,367 | A * | 3/1997 | Chen | G01R 33/3815 62/295 |
| 5,647,218 | A | 7/1997 | Kuriyama et al. | |
| 5,647,228 | A * | 7/1997 | Sager | B01L 7/00 62/49.2 |
| 5,701,744 | A * | 12/1997 | Eckels | F17C 13/02 324/320 |
| 6,107,905 | A * | 8/2000 | Itoh et al. | 335/216 |
| 6,477,847 | B1 | 11/2002 | Bonaquist et al. | |
| 6,640,552 | B1 | 11/2003 | Rampersad et al. | |
| 7,170,377 | B2 * | 1/2007 | Jiang | H01F 6/04 324/318 |
| 7,191,601 | B2 | 3/2007 | Atrey | |
| 7,191,607 | B2 * | 3/2007 | Curtis | B60H 1/00785 318/268 |
| 7,430,872 | B2 * | 10/2008 | Strobel | 62/51.1 |
| 7,631,507 | B2 * | 12/2009 | Stautner | F25B 9/14 324/307 |
| 2002/0002830 | A1 | 1/2002 | Strobel et al. | |
| 2004/0045315 | A1 | 3/2004 | Kamoshita et al. | |
| 2005/0202976 | A1 | 9/2005 | Killoran | |
| 2005/0223714 | A1 | 10/2005 | Li et al. | |
| 2005/0229609 | A1 | 10/2005 | Kirichek et al. | |
| 2006/0021355 | A1 | 2/2006 | Boesel et al. | |
| 2007/0089432 | A1 * | 4/2007 | Boesel et al. | 62/51.1 |
| 2007/0256429 | A1 * | 11/2007 | Fukuda | 62/55.5 |
| 2008/0290869 | A1 * | 11/2008 | Hutton et al. | 324/318 |
| 2009/0293504 | A1 * | 12/2009 | Oomen et al. | 62/51.1 |
| 2009/0293505 | A1 | 12/2009 | Wang | |
| 2010/0281885 | A1 | 11/2010 | Black et al. | |

OTHER PUBLICATIONS

T. Tomaru et al., "Virbration-Free Pulse Tube Cryocooler System for Gravitional Wave Detectors, Part I: Vibration-Reduction Method and Measurement," Cryocoolers 13, Feb. 28, 2005 (pp. 695-702), vol. 13, Springer US.

Takeshi Shimazaki et al., "Gifford-McMahon/Joule-Thomson cryocooler with high-flow-conductance counterflow heat exchanger for use in resistance thermometer calibration," Rev. Sci. Instrum., Mar. 28, 2006, 034902-1 (6 pages), vol. 77, Issue 3, American Institute of Physics.

John Clarke et al., "The Squid Magnetometer-Susceptometer," The Squid Handbook, vol. 2: Applications of Squids and Squid Systems, Oct. 20, 2006 (pp. 400-402), Wiley-VCH.

Cryomech, Inc., various pp. (6).

International Search Report (PCT/US2011/028184), dated Sep. 19, 2012, 8 pages.

* cited by examiner

METHOD AND APPARATUS FOR CONTROLLING TEMPERATURE IN A CRYOCOOLED CRYOSTAT USING STATIC AND MOVING GAS

BACKGROUND

1. Field of the Invention

The present invention relates generally to temperature regulation in a cryostat, with an exemplary purpose of the use of such a cryostat as an apparatus and a method for regulating temperature in a cryogenic measurement chamber, while cooling a superconducting magnet, using a cryogenic cooler as a source of refrigeration.

2. Discussion of the Prior Art

Systems have been available to employ cryostats for temperature regulation in the cryogenic temperature region. One use of such cryostats is to test the physical properties of specimens. The need for testing physical properties of specimens of various types for different properties has increased substantially over the last several years. Systems exist for characterizing the physical properties of various materials under variable measurement conditions by programming an arbitrary sequence of temperature and magnetic field sweeps and steps at which to characterize various physical properties of the sample specimen.

Such systems typically include a cryogenic chamber that has a number of heat shields, a coolant such as helium, a source of refrigeration (cryogenic cooler), a superconducting magnet, a sample chamber, and an apparatus for controlling temperatures, all of which may be referred to as a cryostat. Temperature regulation in a cryogenic test chamber requires a sophisticated balance between supply and loss of thermal energy, and various methods have been devised to accomplish such tasks at low (cryogenic) temperatures. A measure of the efficiency of a specific control scheme is the width of the temperature range over which control can be effectively and efficiently maintained, and the duration and stability achieved at any temperature in this range. An additional measure of the overall system performance is the amount of coolant usage, with lower usage rates being preferred.

One example of such a measurement system utilizes variable temperature field control apparatus, designed to perform a variety of automated measurements. In order to carry out the experiments the system is required to rapidly vary the magnetic fields generally between ±16 Tesla, while maintaining the magnet generally at a constant temperature of about 4.2 K. At the same time, a chamber containing a sample specimen and associated experimental apparatus is typically controlled at an arbitrary sequence of temperatures ranging from about 400 K to below about 2 K. This functionality necessitates a system design that is capable of delivering various amounts of cooling power at different temperatures to different components of the system. In addition, a typical test schedule requires achieving sample temperatures that are below the coldest stage of a typical cryogenic cooler (4.2 K under most practical conditions) and, therefore, employs the process of evaporation of a continuous stream of liquid helium.

Typically, a Gifford McMahon (GM) or a GM-type pulse-tube cryogenic cooler (PTC) is used for this purpose. PT cryogenic coolers provide different amounts of cooling power when operating at different temperature stages. The higher temperature stages provide substantially higher cooling power than the lower temperature stages. An example of such cryogenic cooler is the PT410, sold by Cryomech Inc, of Syracuse, N.Y., which may provide about 40 W of cooling power at the 50 K temperature stage, but only about one watt of cooling power at the 4.2 K stage.

Some presently available designs address the need for providing variable cooling power to the superconducting magnet and the sample chamber by employing a multistage PTC (three or more stages) together with a combination of various methods for coupling the cryogenic cooler to the rest of the cryostat assembly. Flexible braided metal links between the PTC and other elements of the cryostat, such as fixed heat exchanger units, are often used to physically couple PTC cooling elements to the rest of the cryostat. The use of flexible physical links or fixed heat exchangers limits modularity and uses of the measurement system, as the physical links place an upper limit on the heat exchange between the PTC and the other cryostat elements and additional thermal couplings may be necessary if increased heat exchange rate is required. Overall, physical coupling between the cryogenic cooler and the rest of the cryostat substantially complicates maintenance and increases the overall system complexity and cost.

Typically pulse-tube cryogenic cooler units generate vibrations at around 1 Hz frequency under normal operating conditions. Therefore, a system employing physical links transfers superfluous vibration energy from the PTC into the sample area which can be detrimental in applications that are particularly sensitive to small motions, such as optical interferometry, where special care needs to be taken to prevent vibration energy of the PTC from contaminating the sample signal. Efforts have been made to decouple sample signals from the vibration motions of the PTC.

Some presently available cryogenic measurement systems utilize separate re-condenser modules in order to convert gaseous coolant into liquid form that is typically required for cryostat operation at lowest temperatures. This approach increases system complexity and costs while limiting flexibility of use as the re-condenser unit needs to be in physical contact with the PTC. It is recognized in the art that multiple (or multiple stage) cryogenic cooler units are typically required to obtain very low temperatures of about 4.2 K or below.

The challenging task of connecting and disconnecting different cryogenic cooler stages at different temperatures is solved in one prior art example by employing a cryogenic cooler apparatus with at least three stages in combination with multiple heat exchangers and conduits to deliver cooling power from different stages to the desired areas in the cryostat.

Other prior art teaches that at least in theory mechanical valves may be used to open and close the coupling tubes during operation of the multistage cryogenic cooler to regulate cooling power distribution. However, the difficulty of constructing reliable low temperature valves has limited the usefulness of this approach. An alternate method for regulating temperature in the cryogenic chamber uses a dual capillary inlet chamber and multistage cooler/heater apparatus. Although such design allows for smooth temperature regulations in the sample chamber over the desired range it increases cost and complexity of the measurement apparatus and does not address the need of delivering additional cooling power to the superconducting magnet when the latter is operated in sweeping mode.

SUMMARY OF EMBODIMENTS OF THE INVENTION

In a system for temperature regulation which embodies the principles of the invention, a varying magnetic field is generated by a superconducting magnet. In one embodiment, the temperature in a sample chamber is controlled under a variety of temperature ranges by selectively transferring the cooling power from the cryogenic cooler assembly to the different areas within the system apparatus. The magnet assembly is maintained at an approximately constant temperature of 4.2 K, at least in part, by solid conduction contact with a thermally conductive element which is cooled by gaseous or liquid helium that is condensed by the cryogenic cooler.

Such arrangement allows simultaneous temperature sweeping and control of the sample specimen (between 400 K and down to below 2 K) and also cooling of a high-field superconducting magnet using a single multistage, helium-temperature cryogenic cooler that does not rely on the prior art physical links, cryogenic moving parts, and mechanical valves for heat distribution and control. The present system offers rapid initial cool-down (24 hours or less) with very little externally supplied helium gas, and is able to operate for extended periods of time without requiring maintenance and with minimal, if any, helium replenishment. While the system generally operates with liquid helium at the bottom of the cryogenic cooler, gaseous helium at about 4.2 k can be sufficient.

The apparatus of the invention embodiments specifically addresses removal of the large heat load generated by the sweeping superconducting magnet by providing very high conductivity links (solid plates and posts) between the liquid coolant at the bottom part of the cooler chamber and the magnet top-flange. The structure of the cryostat of embodiments of the present invention avoids the commonly used flexible copper links by employing a thermosiphon effect and therefore simplifies the design of the cryostat and provides for larger thermal conductance between the cooling apparatus and the rest of the cryostat.

Evaporative cooling of liquid helium that is drawn from the bottom of the cooler chamber is used for cooling the sample chamber down to below about 2 K. This liquid is produced by condensation on the second stage of the cryogenic cooler and drips into a pool in the bottom of the cooler chamber. This liquid coolant is then delivered to an evaporation chamber via a fixed-flow capillary tube leading from the pool in the bottom of the cooler chamber. During initial system cool-down and during operation, the cooling mechanism for the magnet is through solid conduction in a 4.2 K plate between the magnet and the bottom of the cooler chamber. During normal operation, the bottom of the cooler chamber is cooled by direct contact with the liquid in the cooling chamber. During initial system cool-down, the bottom of the cooler chamber is cooled by buoyant convection with both the first and second stages of the cryogenic cooler.

BRIEF DESCRIPTION OF THE DRAWING

The objects, advantages and features of the present invention will be more readily perceived from the following detailed description when read in conjunction with accompanying drawing, in which.

DETAILED DESCRIPTION OF EMBODIMENTS OF THE INVENTION

The present invention provides an apparatus and a method for temperature regulation in a cryogenic measurement system employing a superconducting magnet by means of using static and moving gas for thermal heat exchange between a cryogenic cooler and the rest of the cryostat assembly.

Cryostat Apparatus

Figure 1:
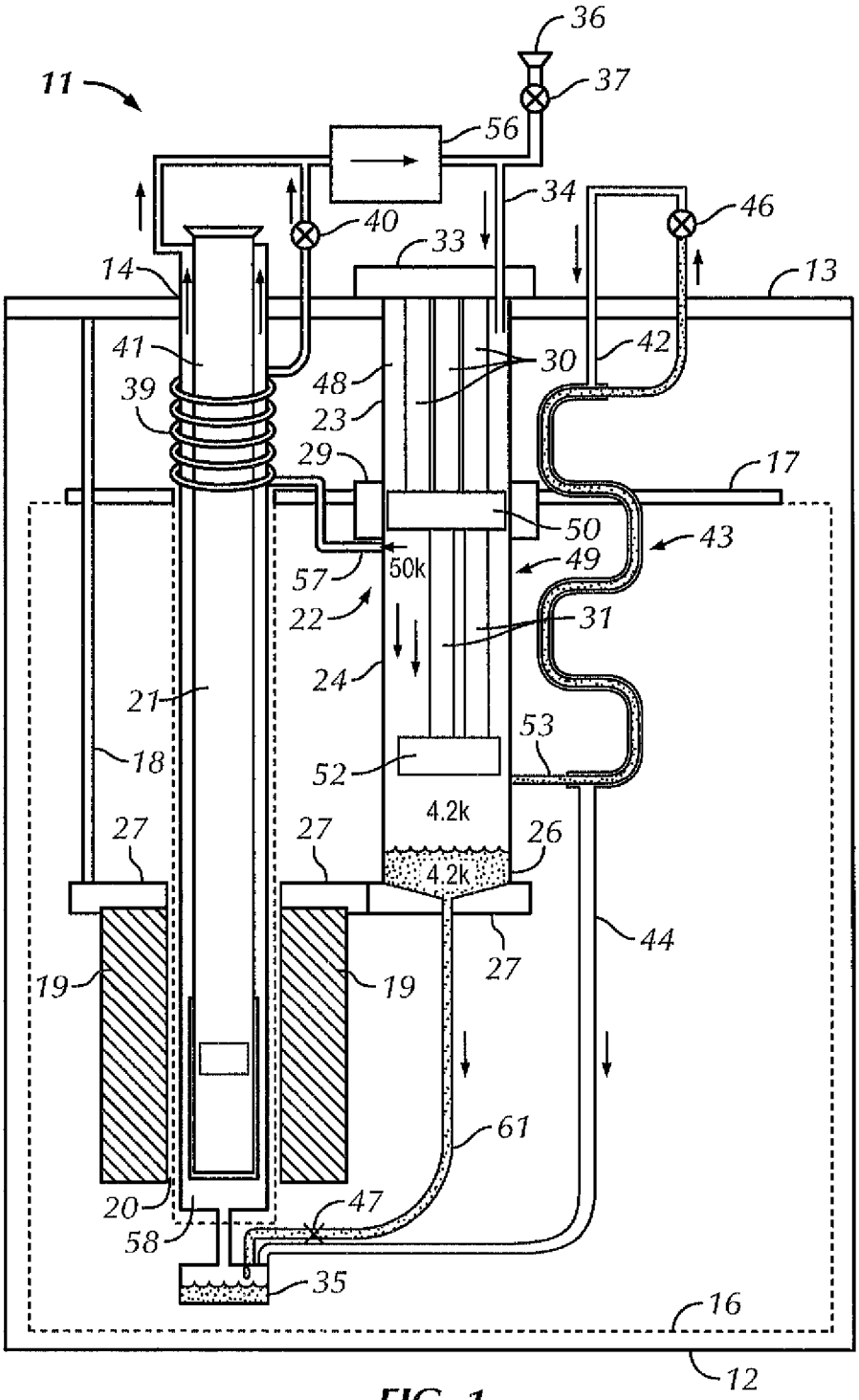
FIG. 1 is a diagrammatic view of and embodiment of the apparatus according to this invention.

An exemplary embodiment of the apparatus of this invention is shown in FIG. 1. Cryostat 11 comprises outer vacuum chamber or outer shell 12 closed at the top by means of top element or plate 13, which may also be referred to as the "300 K" top plate. This top plate may be made of any suitable material such as aluminum, and its upper surface is typically at room temperature. It should be noted that the top of outer shell 12 may be flat, concave, convex, or any other shape, and it could be integral with shell 12. For convenience, element 13 will generally be referred to herein as a top plate. The volume inside this outer shell is evacuated so as to provide thermal isolation. The top plate has an opening, or chamber access port 14 to provide access to sample chamber 21.

As shown in the drawings, the cryostat optionally includes inner shell 16. Inner shell 16 acts as a "50 K" thermal radiation shield and is closed at the top by means of shield plate 17. When included in the cryostat, the shield plate may be is attached to top plate 13 by means of one of more support rods 18 and the wall of upper cooler chamber 23 of cooler chamber 22. Shield plate 17 may be referred to as a "50 K shield plate" or as an "intermediate temperature plate." As is true of top plate 13, shield plate 17 may have any appropriate shape and can be integral with shell 16. While inner shell 16 is not necessary to proper functioning of the cryostat, its use has been found to improve performance of the cryostat.

Superconducting magnet 19, which may be referred to as the magnet apparatus or assembly, is shown inside inner shell 16 and is formed with an inner bore 20 that houses the lower portion of sample chamber 21. Such a sample chamber is employed when cryostat 11 is used as a laboratory instrument. Cryogenic cooler chamber 22 consists of upper cooler chamber section 23, lower cooler chamber section 24, and chamber bottom section 26 which is in direct thermal contact with "4.2 K" plate 27. The 4.2 K plate and chamber bottom section 26 are preferably made of oxygen-free high conductivity (OFHC) copper or other high conductivity materials, such as aluminum, silver, or other grades of copper, to achieve high thermal conduction. Plate 27 may also be referred to as a "low temperature plate," and may have any appropriate shape or configuration. Additionally, the inside surface of bottom section 26 may be configured with fins or other features to enhance thermal exchange with the liquid or gas, or both, in the bottom of the cooler chamber.

Chamber sections 23 and 24 and support rods 18 are typically constructed of conventional G10 fiberglass epoxy material with a metal diffusion barrier in sections 23 and 24. The diffusion barrier prevents coolant from leaking into the vacuum space of the cryostat and reducing the thermal isolation between cryostat components. The G10 rods have a certain amount of flexibility, as is known in the art. The G10 material can be replaced with any low-thermal conductivity material such as stainless steel, copper-nickel, or similar alloys, and plastics such as a polyimide.

The structural support for magnet 19, which may have a mass of up to about 100 kg, is provided by chamber 22, 4.2 K plate 27, and by support rods 18. As an example, support rods 18 may be two or more in number. Cooler chamber 22 is attached to top plate 13, first-stage neck ring 29, and 4.2 K plate 27 by any appropriate thermally conductive means such as glue or some other adhesive. Support rods 18 are appropriately connected to top plate 13, 50 K shield plate 17, and 4.2 K plate 27 by any appropriate means.

Any lateral thermal contraction of 50 K shield plate 17 with respect to top plate 13 that may occur is accommodated by the relative flexibility of the support rods 18. The relatively large distance between the support rods and chamber sections 23 and 24 significantly reduces potential vertical deformations within the 4.2 K plate that could otherwise result from imbalanced thermal contraction of the support rods versus contraction of cooler chamber 22. Lateral and torsional rigidity of the assembly are primarily provided by chamber sections 23 and 24 while the vertical support and alignment comes from the combination of the chamber sections and the support rods.

While the cryostat apparatus, as shown in the drawings, has a generally vertical orientation, except for the cooler, which resides in cooler chamber 22, the components need not be arranged vertically.

PT Cooler Apparatus

An exemplary embodiment, this system employs a conventional pulse-tube cryogenic cooler (PTC) as the source of cooling power in the cryostat apparatus. The PTC cooler is a unit comprised of top or ambient temperature flange 33, tubes 30 and 31, and cooling stages 50 and 52, all of which reside within chamber 22. This cooler typically has at least two cooling stages, each providing different amounts of cooling power at different temperatures. The higher temperature stage of the PTC cooler provides substantially higher cooling power compared to the lower temperature stage. For example, a typical PTC cooler suitable for the described embodiments of the present invention, such as the Cryomech PT410, may have a first-stage 50 with a cooling capacity such that it can maintain a temperature of 50 K with a 40 W heat load, but would only maintain 30 K with a 1 W heat load. By comparison, second stage 52 does not provide as much cooling capacity at 50 K, but can maintain 4.2 K with a 1 W heat load. Full cooling capacity is available at both stages simultaneously.

Other types of cryogenic coolers can be utilized, but the PTC cooler is applicable because, in addition to providing cooling power from the distinct cooling stages, this cooler can provide cooling at a continuum of temperatures at the regenerator regions located between the distinct stages. The apparatus of the present invention can take advantage of this additional cooling power because the coolant is in direct contact with all exterior surfaces of the cooler. In this configuration, the PTC cooler is particularly well suited for refrigerating coolant gas from ambient temperature, since more heat can be extracted from the gas at higher temperatures before encountering cooler stages. This principle of extracting heat at the highest-possible temperature is well known in the art as a way to achieve high cooling efficiency.

As used herein, the general term, "coolant," can be either a gas or a liquid, and "refrigerated coolant" can also be either a gas or a liquid.

Another reason the PTC cooler is the cooler type of choice for these embodiments is because the portion of this cooler that is in intimate contact with the cryostat has no moving parts. As a result, the cooler imparts significantly lower vibrations into the cryostat as compared to a GM-type cooler. This is a significant benefit because these vibrations could adversely affect measurement quality in a physical-property measurement system.

Cooling Distribution and Coolant Flow

The apparatus of the present invention utilizes gas exchange as the primary means for extracting cooling power from the various stages of the PTC cooler and delivering this cooling power to various cryostat components. Ambient-temperature flange 33 of the cryogenic cooler is mounted to top plate 13 and cooling stages 50 and 52 are located inside cryogenic cooler chamber 22. Main coolant inlet tube 34 is attached to an external coolant inlet or fill port 36 through ambient temperature valve 37 to a source of ambient-temperature coolant gas (for example, helium, which may be a helium-4 isotope, which may be selectively connected to a gas bottle (not shown) and gas recirculation pump or pumping system 56. This is the source of coolant for cryogenic cooler chamber 22. It is possible that valve 37 can be dispensed with and that fill port 36 can be an external reservoir of coolant.

Coolant gas entering the inlet port is refrigerated by thermal exchange with the cooler stages. As the coolant travels down along first cooler chamber tubes 30 it transfers heat via convective thermal exchange to first cooling stage 50 and subsequently along second cooler chamber tubes 31 to second cooling stage 52 of the cryogenic cooler. The resulting refrigerated coolant cools any heat-conducting regions in the walls of the cooler chamber, which then cool other components in the cryostat by solid-conduction contact with the conducting region on the outside of the chamber. For example, refrigerated coolant in the vicinity of first stage 50 cools neck ring 29 and the entire 50 K shield plate assembly 17 to which the neck ring is thermally coupled, while refrigerated coolant near second stage 52 cools bottom section 26, 4.2 K plate 27, and magnet assembly 19. The bottom section, 4.2 K plate, and magnet assembly are all thermally coupled. Other cryostat components, an example being sample chamber 21, can be cooled by thermal exchange with circulating refrigerated coolant gas or liquid, or both, siphoned from different locations within the cooler chamber. The vacuum isolation space and thermally insulating chamber sections 23 and 24 significantly reduce other stray thermal communication between cryostat components.

Because the refrigerated coolant is used for transferring the cooling power from the cooler to the walls of the cooler chamber and to the other refrigerated components in the cryostat, there are no physical connections coupling either the first stage or the second stage of the PTC cooler to the rest of the cooler chamber or the cryostat. This arrangement allows for a very high level of modularity with respect to the cryogenic cooler integration since there are no mechanical connections or flow control apparatus required between cooling stages 50 and 52 of the cryogenic cooler and cooler chamber 22 below ambient-temperature flange 33. This structure offers substantial advantages over previously available systems, including reduced construction complexity, higher reliability due to fewer mechanical parts, ease of maintenance and repair, reduced vibration coupling between the cryogenic cooler and the other cryostat components, as well as more flexible control of delivering cooling power to the rest of the measurement system.

Figure 3:
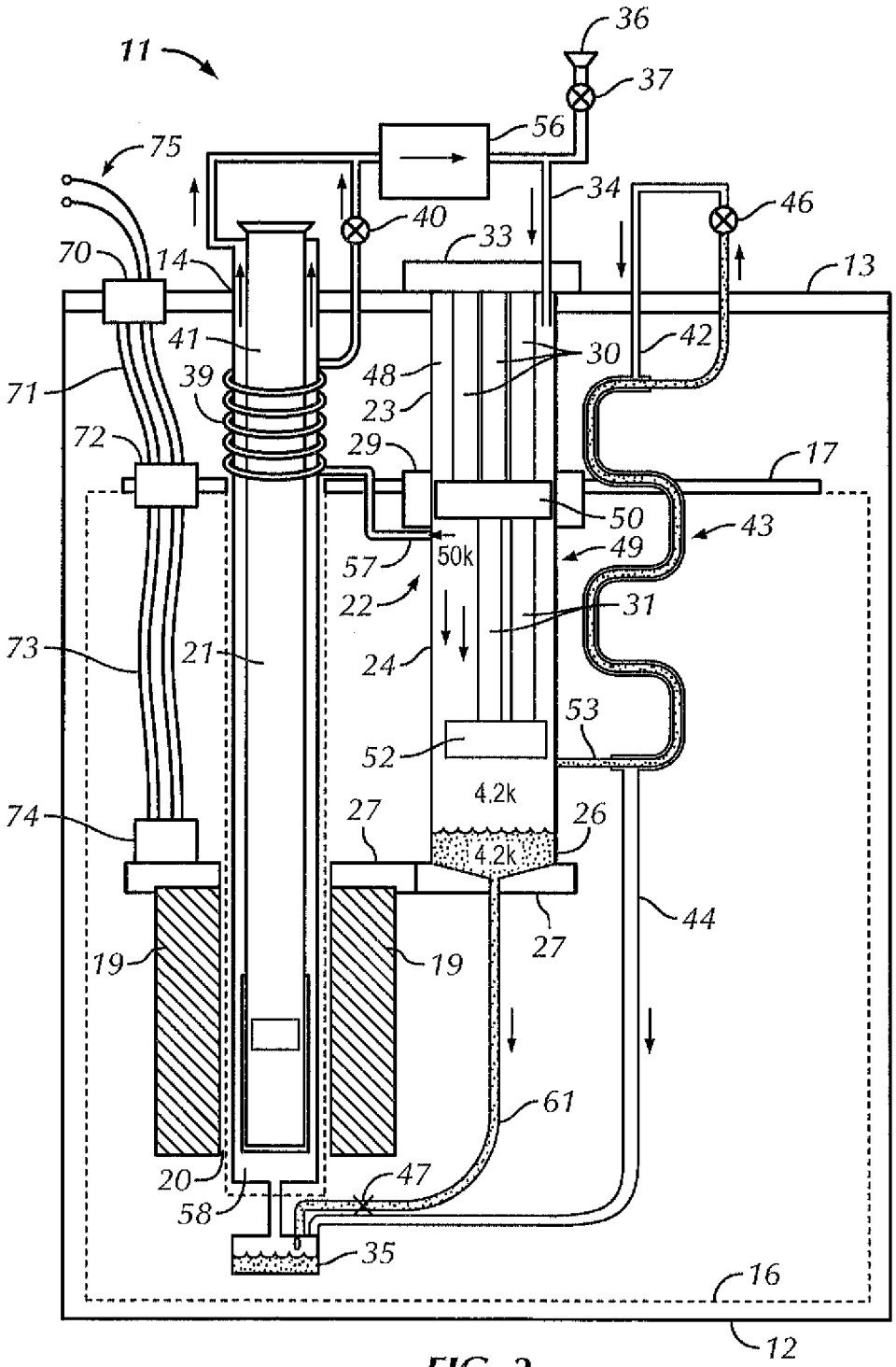
FIG. 3 is a diagrammatic view of the cryogenic vessel showing details of the superconducting magnet lead assembly of the apparatus according to this invention.

Another optional cryostat component that is cooled by the above mechanism is the current lead assembly for superconducting cryogenic temperature magnet 19, as shown in FIG. 3. The magnet must be connected to a room-temperature power supply to provide the electric current necessary for producing the magnetic field. This current can exceed 100 amps and so requires large electrical conductors between the room-temperature region outside the cryostat and the magnet inside the cryostat. Unfortunately, large normal-metal (non-superconducting) conductors also conduct a large amount of heat. This can produce an unacceptable heat load on the lowest-temperature components in the cryostat. In this embodiment normal metal conductors 71 are employed between terminal 70 coupled to top plate 13 and thermal anchor 72 at the first stage temperature. Superconducting leads 73 carry the current between the first stage anchor and thermal anchor 74 at the temperature of the magnet. A thermal anchor at the first stage temperature ensures that the entire length of superconducting lead is cold enough to remain below its transition temperature during normal operation. For superconductors made from the superconductor yttrium barium copper oxide (YCBO), the transition temperature is about 90 K. A use of superconducting magnet leads is known in the art where high currents are required at cryogenic temperatures. In this embodiment, the thermal anchor points at both bottom 74 and top 72 of the superconducting leads are provided by solid thermal conduction to 4 K plate 27 and first stage neck ring 29, respectively. Unlike prior art, this thermal contact is achieved without direct physical connections to the cooler stages. External, ambient temperature leads 75 are provided for connecting to necessary power supply (not shown). For purposes of clarity, support rod 18 is not shown here.

Pressure Relief

In the event of a cryostat vacuum breach, in some prior systems liquid coolant in the cooler chamber could be suddenly heated and expand explosively. Without a large orifice exhaust port, over-pressure in the chamber could burst the cooler chamber walls. In the apparatus of the present invention, the cooler is arranged so that a substantial over-pressure in the chamber will displace the cooler upward, thus relieving the pressure. This is made possible by the lack of constraining solid links to the cooler tubes and stages. More specifically, there are no physical linkages between the cooler (tubes 30, 31 and stages 50, 52) and cooler chamber 22, so the cooler can effectively self function as a pressure-relief safety device.

Coolant Stratification and Siphoning

Continuous thermal exchange between the coolant and the PTC cooler along the length of cryogenic cooler chamber 22 cools down and eventually condenses gaseous coolant preferably to the liquid phase, which pools in the bottom section 26 of the cryogenic cooler chamber. This progressive thermal exchange, as well as the natural thermal stratification of the coolant within cryogenic cooler chamber 22, allows the refrigerated coolant to be drawn from the column at different temperatures and phases. Near the first stage, gaseous coolant can be siphoned at about 50 K. Near the second stage, gaseous coolant at about 4 K can be siphoned above the liquid level, and liquid coolant can be siphoned through tube 61 from the pool at the bottom of the chamber. It should be noted that it is not necessary for the coolant to become liquid in order for the system to function effectively, because gas at about 4 K can perform the desired cooling functions.

In a preferred embodiment, the 50 K coolant is drawn from cooler chamber 22 through first-stage siphon 57, passes through a neck exchanger 39, which is arranged around upper neck area 41 of sample chamber 21, and is used for intercepting heat that travels down from the chamber access port 14. The cooling power of this neck exchanger 39 is controlled using ambient-temperature neck valve 40. No cryogenic valve is required.

The natural thermal stratification of gaseous coolant within cooler chamber 22 also allows a very effective standby mode for the apparatus of the present invention. Because of the substantial power consumption (5,000 to 10,000 W) of the cryogenic cooler, it is desirable to turn it off when the system is not being used. However, if the apparatus is allowed to warm to near room temperature, it takes about one day to cool it to operating temperature again. When a cooler is turned off, the coldest stages warm very quickly by conducting heat from the warm flange of the cooler. In conventional designs, which typically use metallic thermal links to the cooler stages, the turned-off cooler rapidly heats the rest of the cryostat through the thermal links. However, in the present apparatus, the thermal stratification of the coolant in cooler chamber 22 significantly reduces heat transfer to bottom section 26 of the chamber when the cooler is warmer than the bottom. This is a property of a thermosiphon and allows the cooler to be turned off for up to an hour while maintaining liquid or gas coolant in bottom section 26 of chamber 22 at about 4.2K. A program of cycling the cooler on for 30 minutes and off for one hour can reduce the power consumption of the apparatus by more than half, while allowing full system operation within an hour of exiting this standby mode.

Counter-Flow Exchanger

The 4.2 K coolant drawn from bottom section 26 of the cooler chamber via cold gas siphon 53 is used to cool sample chamber 21. The flow rate of this coolant is controlled by means of a counter-flow heat exchanger (CFE) 43 and ambient temperature CFE flow valve 46. The coolant at 4.2K flows through cold gas siphon 53 into the warming conduit of CFE 43, flows through CFE flow valve 46, enters cooling conduit 42 of the CFE, enters the chamber gas coolant conduit 44, and then flows into the cooling annulus 58 surrounding the bottom of sample chamber 21. Evaporation chamber 35 is shown in the drawing between conduit 44 and cooling annulus 58, but this is an alternative element that is not necessary to the operation of the disclosed embodiments. By using a CFE in this manner, full control of the refrigerated coolant flow is achieved with the use of a reliable and commercially available ambient-temperature flow-controlling valve 46, with little or no parasitic heating of the refrigerated coolant. A typical flow rate through the CFE valve will vary between about 0 and 10 standard liters per minute. Again, no cryogenic valve is required.

In counter-flow heat exchanger 43, refrigerated coolant traveling from the siphon 53 to CFE flow valve 46 in the first exchanger conduit is progressively warmed along its length by continuous thermal exchange with the counter-flowing coolant stream traveling back from valve 46 through conduit 42 to coolant conduit 44. Because the two exchanger conduits are in intimate thermal contact along their lengths, at each point along the length heat from the coolant in the second (cooling) conduit is transferred into the coolant in the first (warming) conduit. An efficient exchanger design ensures that temperatures of the coolant in both the warming and cooling flows are nearly identical at any point along the length of the exchanger. Consequently, an insignificant amount of heat is introduced into the refrigerated coolant by this valve scheme and the refrigerated coolant can be controlled up to full flow rate at or near the temperature (4.2 K) of the second stage of the cooler.

As the coolant travels down cryogenic cooler chamber 22 from first stage 50 to second stage 52 it is cooled down to about 4.2 K at which point it is susceptible to condensation into liquid form on the second stage condenser of the PTC cooler. When the system is operating with liquid coolant, condensed liquid coolant drips down from second stage cooling stage or condenser 52 and pools in bottom section 26 of the cryogenic cooler chamber.

As the heat from the magnet is conducted through 4.2 K plate 27 this heat flux warms up the liquid coolant that is pooled in bottom section 26, causing some of the liquid coolant to evaporate. Some of the evaporated gaseous coolant subsequently re-condenses on second-stage condenser 52 and then drips back to the bottom. The bottom section of the cryogenic cooler chamber and the second stage condenser thereby form a classic two-phase heat pipe. A two-phase heat pipe of this type is very efficient at transferring heat. The described use of the heat pipe mechanism in this embodiment of the invention provides for efficient heat transfer away from the superconducting magnet at its operating temperature of about 4.2 K without requiring solid thermal contact with second-stage 52 of the cooler. In the case where the magnet is above its operating temperature as, for example, when the magnet and cryostat are being cooled from ambient temperature, this geometry functions as a single-phase heat pipe.

A further advantage of this method of thermal contact is that the effective thermal conductance between the two elements of the heat pipe is independent of the distance between PTC cooler second stage 52 and cooler chamber bottom section 26. This is a property of a two-phase gravitational thermosiphon. This height independence makes the system of the described embodiments of present invention adaptable to different cryogenic cooler lengths and dimensions of the cryostat apparatus.

Solid Thermal Coupling

The high-field superconducting magnet that is utilized in the temperature regulation system of the disclosed embodiments of the present invention generates magnetic fields up to about 16 Tesla, weighs up to about 100 kg (220 lbs), and dissipates up to about one watt of heat while operating in sweeping mode. Such a high heat load is near the cooling capacity of the PTC cooler at 4.2 K. As mentioned, the two-phase thermosiphon addresses the conduction of heat between bottom section 26 of the cryogenic cooler chamber and second-stage 52 of the cooler. The design of the exemplary embodiment specifically addresses the conduction of heat from superconducting magnet 19 to bottom section 26 of the cryogenic cooler chamber via the solid conduction path through 4.2K plate 27, thereby providing a very high thermal conductance link. This high conductance is needed to keep the magnet cold for proper operation during sweeping mode during which time the magnet dissipates heat. This combination of thermosiphon and solid links completely avoids flexible copper thermal links between the cooler stages and the cryostat components, which have typically been used in conventional systems to provide thermal conduction. This structure also eliminates mechanical stress resulting from differential thermal contractions of the cryostat with respect to the cryogenic cooler stages. Since the thermosiphon accommodates the differential thermal contraction in the disclosed embodiments, the flexibility of conduction links is not needed. The solid links involve a large cross-section area-to-length (A:L) ratio which provides for a solid conduction path. It is much more efficient to employ a thermal link with high A:L ratio using solid plates and posts than to use an equivalent heat transfer with flexible links, as has been common in the past.

Furthermore, the measurement system of the disclosed embodiments of the present invention is configured so that the temperature of sample chamber 21 is decoupled, to a large degree, from the cooling power available at magnet apparatus 19. This is because the cooling power for the magnet comes from the liquid in the bottom (26) of cooler chamber 22, which is at its saturation temperature, whereas the cooling power for the sample chamber comes primarily from flowing gas coolant from above the liquid level in the bottom of the cooler chamber. Below a critical flow rate, changes in the gas flow rate have only a small effect on the pool of liquid coolant. This enables temperature control and magnetic field operation to be performed independently of each other. That is, when combined with heaters on the sample chamber and closed-loop temperature control, changing temperature of the specimen does not significantly affect the temperature of the superconducting magnet. Conversely, changing the field in the magnet also does not significantly affect the temperature of the specimen in the sample chamber. Therefore, when the superconducting magnet is swept by varying the current in the magnet coils, the significantly higher heat load from the magnet does not significantly affect the temperature control of the sample chamber. Once the system is in the operational state, the sample can be warmed or cooled between the base temperature (less than 2 K) and ambient-temperature (about 400 K) or above in a short period of time (less than about 60 minutes) without substantially affecting the temperature of the magnet or the cryogenic cooler.

Rapid Pre-Cooling

Figure 2:
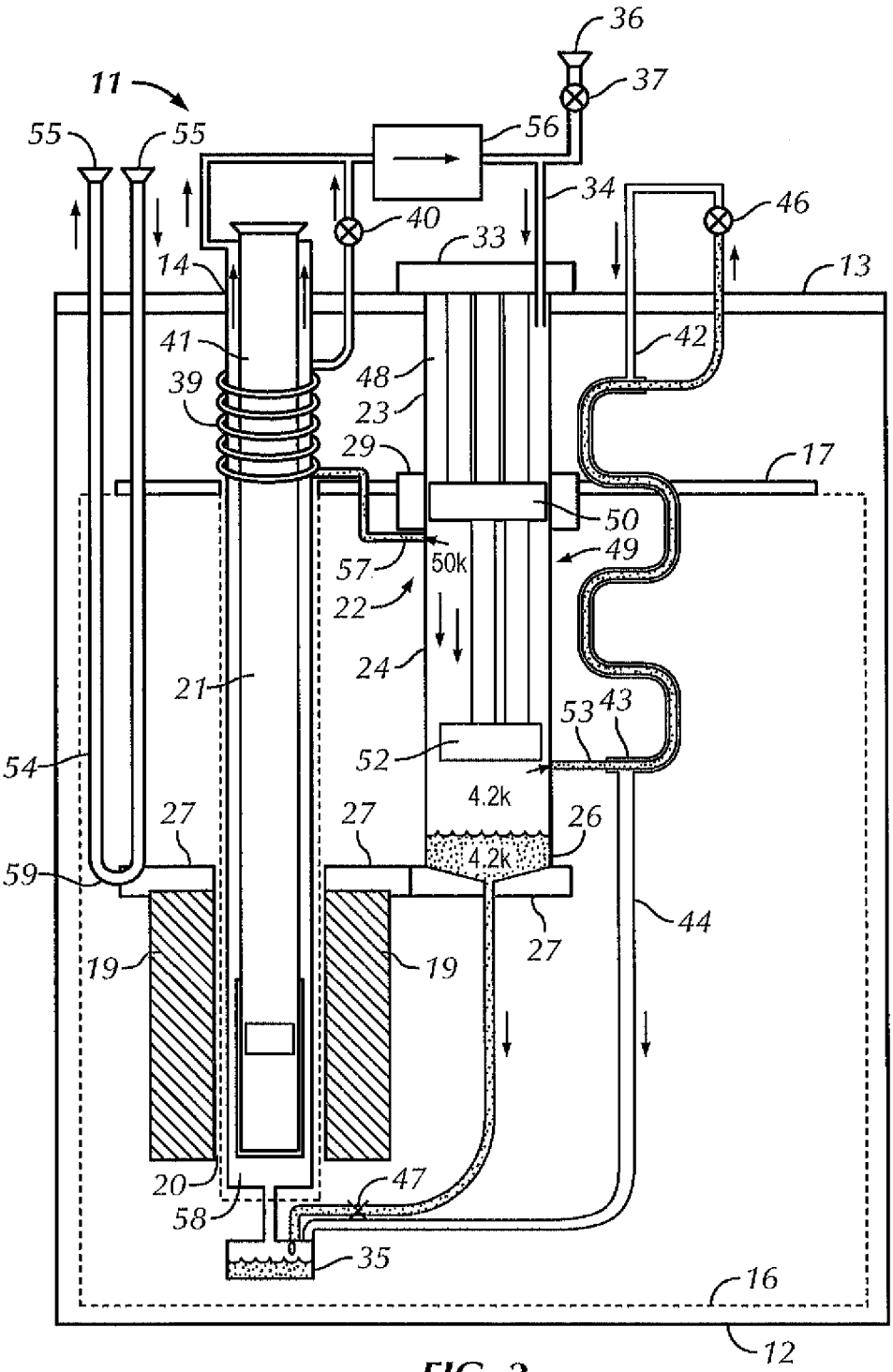
FIG. 2 is a diagrammatic view of an alternative embodiment of the apparatus according to this invention.

In one embodiment during initial system cool-down and during operation, the primary cooling mechanism for the magnet is through the solid conduction of 4.2 K plate 27 which is coupled between the magnet and the coolant in chamber bottom section 26. An alternative embodiment, depicted in FIG. 2, employs the transfer of liquid nitrogen or helium coolant from an external storage dewar (not shown) into a pre-cooling conduit 54 that is thermally coupled to 4.2 K plate 27 using heat exchanger 59 for the purpose of accelerating initial cool-down of the magnet assembly to about 77 K, for example. In this case a transfer tube (not shown) is manually connected to a pre-cooling port 55 and nitrogen or helium flow is maintained via pressure in the storage dewar. The helium employed in the heat exchanger may be a helium-3 isotope. When the system has cooled to about 77 K, the transfer tube is disconnected and pre-cooling ports 55 are sealed to prevent icing. The rest of the cool down process proceeds using only the cooler as previously described. Such pre-cooling arrangement reduces the startup time of the cryostat operation. Support rod 18 does not appear in this figure for clarity since it is in the same vicinity as conduit 54.

System Startup and Buoyant Convection

Returning now to FIG. 1, because of the large heat capacity of superconducting magnet 19, efficient use of each stage of the cryogenic cooler is needed to minimize cool-down time. When the temperature of magnet assembly 19 and chamber bottom 26 are above the first-stage 50 temperature of about 50 K, the open, vertical column of cryogenic cooler chamber 22 allows for efficient buoyant convection between cooler chamber bottom section 26 and both stages (50, 52) of the cryogenic cooler, as well as second-stage regenerator region 49 of the cooler. When the chamber bottom temperature is below the first-stage temperature, the height of the buoyant convection is reduced to below the level of the first-stage and the gas thermally stratifies in the vicinity of the first-stage. As a result, the first-stage of the cooler is thermally isolated from the colder gas below, while thermal exchange via buoyant convection continues between chamber bottom 26 and second stage 52 and second-stage regenerator region 49 of the cooler. Effectively, the thermal link between the first-stage and chamber bottom 26 is broken when this occurs. This automatic crossover from first-stage cooling to second-stage cooling during system cool-down is a feature of the open, vertical-column design of the cooler chamber. This design is highly efficient because it extracts heat from bottom section 26 using the highest-temperature stages available at any given point in the cool-down. In the measurement system of the preferred embodiment of the present invention, the system cool-down time to operating temperature is about 24 hours. Once the magnet is cooled down to normal operating temperature of about 4.2 K, continuous cooling of chamber bottom 26 and magnet 19 occurs through the two-phase thermosiphon effect as described above.

Cryopump Assembly

For certain applications, as in the case where sample chamber 21 is an environmental chamber in a laboratory instrument, it may be necessary to evacuate the chamber to a high vacuum state (<1 mTorr) for the purpose of performing certain measurements or for preparing laboratory specimens. Cryopumps are known in the art to provide excellent high vacuum conditions. Normally cryopumps are expensive because of the need for cryogenic temperatures and thermal isolation of the cold stages from the environment. However, because of the ability to cool multiple refrigerated components simultaneously, embodiments of this invention provide the cooling stages and thermal isolation necessary for a high-performance, multistage cryopumps with very little additional expense. There is a further advantage to this integrated design since the conduit connecting the pumped volume to the cryopump is very short, thus increasing the pumping rate as compared to a remote mounted pump.

Figure 4:
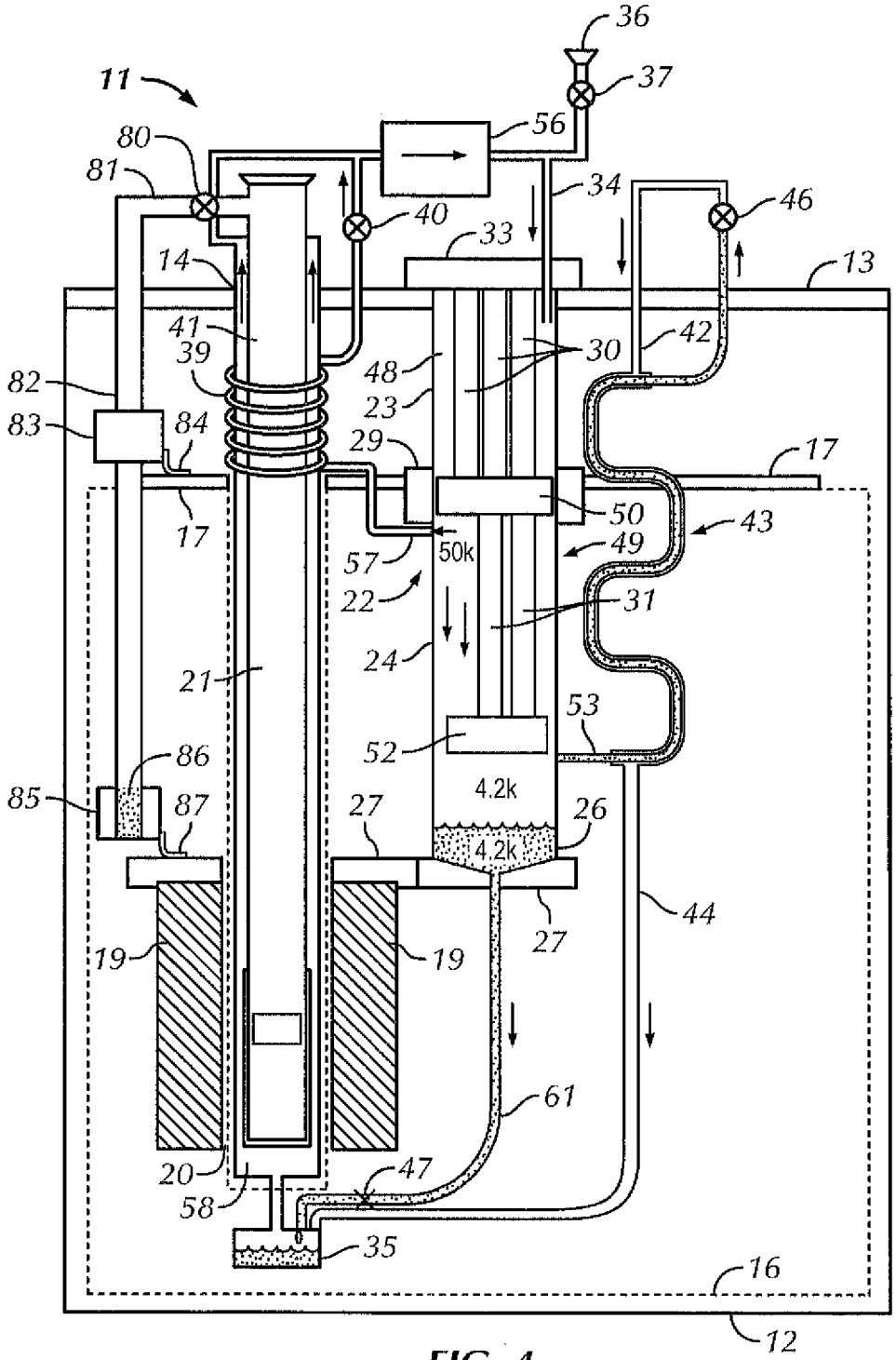
FIG. 4 is a diagrammatic view of the cryogenic vessel showing details of the cryopump assembly and thermal and gas connections to the cryostat assembly of the apparatus according to this invention.

An embodiment of such a cryopump assembly is shown in FIG. 4. Ambient-temperature pumping conduit 81 connects upper neck area 41 of sample chamber 21 to cryopump tube 82. The cryopump tube feeds through top plate 13 into the vacuum space of the cryostat. First stage cold trap 83 of the cryopump is maintained at the temperature of the first stage via flexible thermal link 84 to 50 K shield plate 17. Conduit 88 extends from cold trap 83 into inner shell 16 to second stage cold trap 85. Sorption pump 86 and cold trap 85 are maintained at the temperature of 4.2 K plate 27 via second thermal link 87. Ambient temperature isolation valve 80 is used to seal the cryopump from the sample chamber when high vacuum is not required in sample chamber 21 or when ambient atmosphere access to the chamber is required. Support rod 18 is not shown here for purposes of clarity.

System Operation

In order to cool the sample chamber below the second stage temperature of the cryogenic cooler, which is typically about 4.2 K, the system of the described embodiments of present invention can alternatively utilize an evaporative cooling mechanism that takes place in evaporation chamber 35. The liquid coolant that is collected in bottom section 26 acts as the source for capillary flow impedance 47 that has a flow within the range between about 0 and about 1 standard liter per minute. This flow of liquid coolant enters and collects in evaporation chamber 35 at low temperatures. This liquid is then evaporated and cooled due to pumping on the cooling annulus 58 surrounding sample chamber 21 by pumping system 56. In the absence of coolant flow in conduit 44, the cold evaporated coolant cools the sample chamber down to below about 2 K.

The measurement system of the depicted embodiments of the present invention utilizes gas flow cooling of the sample chamber using a single stream of gaseous coolant that flows past sample chamber 21. The flow rate and temperature of this coolant flow are varied according to the cooling needs by mixing different amounts of gaseous coolant supplied through chamber gas coolant conduit 44 and liquid coolant supplied though capillary impedance 47 into evaporation chamber 35 (when this alternative structure is used). The coolant through coolant conduit 44 is supplied at a temperature of about 4.2 K and at rates varying from about 0 up to about 10 standard liters per minute. The evaporated coolant is then usually at a temperature below 2 K, and at a flow rate that is normally fixed by a capillary impedance at between about 0.2 and about 1 standard liter per minute. The mixing of coolant flows from different sources having different temperatures and cooling capacities allows for achieving appropriate cooling rate and required base temperature within sample chamber 21. Rapid cooling of the sample chamber when above about 4.2 K is achieved by flowing gas through ambient temperature CFE valve 46 that causes coolant flow in coolant conduit 44. Cooling of the sample chamber to below 4.2 K is achieved by shutting-off the flow in valve 46, leaving a relatively smaller flow of colder gas past sample chamber 21. Warming of the sample chamber and stabilization at a fixed temperature can be achieved using heat applied directly to the sample chamber with a heater element (not shown) attached to the chamber walls.

A benefit of the closed-loop arrangement used in this embodiment of the present invention is the ability to prevent contaminated gas from plugging coolant circulation loops by using a single cold-trap for coolant ingress. A cold trap is a device that freezes all vapors except the coolant gas and is necessary at each inlet from the gas source and circulation pump 56 to prevent icing and plugging of the cryogenic conduits and capillaries in the cryostat. Cold traps are rather large and can add considerable complexity to a design, so it is advantageous to have as few coolant inlets as possible. In this embodiment of present invention, coolant entry into cryostat 11 is limited to a single inlet port 36, 37, 34 that is used to deliver ambient coolant gas into multiple circulation loops (39, 44, and 61) within the cryostat assembly. Furthermore, the volume 48 of the cooler chamber between ambient-temperature flange 33 and first-stage 50 of the cooler provides the functionality of a high-capacity cold-trap. This eliminates the need for a separate dedicated cold-trap assembly and thereby considerably simplifies the design.

All coolant flow control valves (37, 40, 46) are shown external to outer shell 12 and at the top of the cryostat. It should be noted that it is only relevant that these valves be at or near ambient temperature; they need not be in conduits which extend through top 13. Access for the conduits in which those valves are coupled can be through the sides of the outer shell as well as through the top.

While exemplary and alternative embodiments of the invention have been presented in detail above, it should be recognized that numerous variations may exist. It should also be appreciated that the described embodiments are only examples, and are not intended to limit the scope, configuration, or applicability of the described invention in any way. It should be understood that various changes can be made in the function and arrangement of elements without departing from the scope as set forth in the appended claims and the legal equivalents thereof.

What is claimed is:

1. A cryostat apparatus for regulating temperatures, the apparatus comprising:

an outer shell having an interior and having a top with an outer surface, the outer surface of said outer shell top being at ambient temperature, at least one refrigerated component within the cryostat, said at least one refrigerated component requiring cooling selectively with variable heat loads and operating temperatures;

a cryogenic cooler with at least one reduced-temperature stage;

a cryogenic cooler chamber containing said at least one reduced-temperature stage of the cryogenic cooler;

at least one ambient-temperature coolant gas inlet port penetrating said cryogenic cooler chamber;

means for connecting the cryostat apparatus to a source of ambient temperature coolant gas;

a main gas inlet conduit for connecting said source of ambient temperature coolant gas to said ambient temperature coolant gas inlet port, said at least one ambient-temperature coolant gas inlet port being at ambient temperature;

at least two siphoning ports comprising a first siphoning port and a second siphoning port, in fluid communication with the cryogenic cooler chamber, said first siphoning port being arranged to remove refrigerated coolant from said cryogenic cooler chamber in gas form and said second siphoning port being arranged to remove refrigerated coolant from said cryogenic cooler chamber in liquefied form, the refrigerated coolant having been cooled from ambient temperature by thermal exchange with said at least one reduced-temperature stage of said cryogenic cooler;

a first coolant conduit and a separate second coolant conduit connecting said first and second siphoning ports, respectively, to said at least one refrigerated component, the first and second coolant conduits being separate and distinct from each other; and at least one cryostat exit extending from said at least one refrigerated component to outside the cryostat and configured to flow coolant out of the cryostat after providing cooling to said at least one refrigerated component, a first ambient temperature flow control valve located external to said outer shell;

a counter-flow heat exchanger in fluid communication with said first coolant conduit and arranged to warm said refrigerated coolant to ambient temperature wherein said refrigerated coolant passes through said first ambient temperature flow control valve and is then cooled back down by the thermal action of the counter-flow heat exchanger and is subsequently delivered to said at least one refrigerated component, wherein said at least one refrigerated component comprises a sample chamber for measurement of or preparation of a laboratory specimen;

said counter-flow heat exchanger and said first ambient temperature flow control valve being configured to control the flow of said refrigerated coolant to said thermal environmental chamber.

2. The cryostat apparatus recited in claim 1, wherein said cryogenic cooler chamber has at least one thermally conducting region at a reduced temperature portion of the wall, said region being arranged to provide a thermal conduction path between said at least one refrigerated component located outside said cryogenic cooler chamber and an exchanger surface located inside said cryogenic cooler chamber, said exchanger surface being in thermal contact with the refrigerated coolant within said cryogenic cooler chamber.

3. The cryostat apparatus recited in claim 1, where said at least one refrigerated component further comprises a thermal radiation shield.

4. The cryostat apparatus recited in claim 1, wherein said at least one refrigerated component further comprises a superconducting magnet assembly.

5. The cryostat apparatus recited in claim 1, wherein said at least one refrigerated component further comprises a cryopump assembly.

6. The cryostat apparatus recited in claim 1, wherein said at least one refrigerated component further comprises a cryopump assembly comprising:

a first conduit extending from an ambient temperature isolation valve through said outer shell top into the interior of said outer shell;

a first stage cold trap within said outer shell to which said conduit is connected; a second stage cold trap within said outer shell;

a second conduit extending from said first stage cold trap to said second stage cold trap; and a sorption pump coupled within said second stage cold trap.

7. The cryostat apparatus recited in claim 1, wherein the coolant gas is helium or an isotope of helium.

8. The cryostat apparatus recited in claim 1, wherein said cryogenic cooler is formed with upper and lower surfaces and said cryogenic cooler chamber is formed with upper and lower surfaces, said cryogenic cooler and said cryogenic cooler chamber are oriented vertically and arranged so that the upper surfaces of both said cryogenic cooler and said cryogenic cooler chamber are warmer than the lower surfaces of both said cryogenic cooler and said cryogenic cooler chamber and coolant within said cryogenic cooler chamber thermally stratifies, with colder, more dense coolant below the warmer, less dense coolant.

9. The cryostat apparatus recited in claim 1, and further comprising a gas recirculation pump external to said outer shell and having an inlet port and an outlet port, said outlet port being coupled to said main gas inlet conduit and said inlet port being coupled to said at least one cryostat exit conduit, said recirculation pump providing a pressure drop for driving the coolant.

10. The cryostat apparatus recited in claim 8, where coolant gas entering said cryogenic cooler chamber is cooled by said cryogenic cooler to collect as liquid coolant at the bottom of said cryogenic cooler chamber.

11. The cryostat apparatus recited in claim 10, and further comprising a thermally conducting element thermally coupled between the bottom of said cryogenic cooler chamber and said at least one refrigerated component external to said cryogenic cooler chamber and within said cryostat.

12. The cryostat apparatus recited in claim 10, wherein the bottom of said cryogenic cooler chamber is configured with a heat exchanger surface on the inside of said cryogenic cooler chamber which is in direct contact with the liquid coolant located in the bottom of said cryogenic cooler chamber, the bottom of said cryogenic cooler chamber being a thermally conducting region configured to provide a thermal conduction path between said heat exchanger surface and said at least one refrigerated component.

13. The cryostat apparatus recited in claim 8, wherein said cryogenic cooler chamber has an inside and a bottom, the bottom being configured with a heat exchanger surface on said inside which is in direct contact with the refrigerated coolant at the bottom of said cryogenic cooler chamber, the bottom of said cryogenic cooler chamber being a thermally conducting region configured to provide a thermal conduction path between said heat exchanger surface and said at least one refrigerated component.

14. The cryostat apparatus recited in claim 13, wherein said cryogenic cooler chamber adjacent to said heat exchanger surface is configured to permit thermal exchange between said at least one reduced temperature stage and said heat exchanger surface via buoyant convection under a condition that the at least one reduced temperature stage is colder than said heat exchanger surface.

15. The cryostat apparatus recited in claim 12, wherein said at least one refrigerated component further comprises a superconducting magnet assembly.

16. The cryostat apparatus recited in claim 13, wherein said at least one refrigerated component further comprises a superconducting magnet assembly.

17. The cryostat apparatus recited in claim 10, and further comprising:

a flow restricting device; and an evaporation chamber;

said flow restricting device being connected in one said second coolant conduit between the bottom of said cryogenic cooler chamber and said evaporation chamber to deliver liquid coolant to said evaporation chamber at a pressure less than the pressure at the bottom of said cryogenic cooler chamber to enable the temperature in said evaporation chamber to be below the temperature of the liquid coolant in the bottom of said cryogenic cooling chamber.

18. The cryostat apparatus recited in claim 1, and further comprising a second ambient temperature flow control valve in one said at least one cryostat exit conduit downstream of said at least one refrigerated component, said second ambient temperature flow control valve being coupled and configured to control flow of refrigerated coolant upstream to said at least one refrigerated component.

19. The cryostat apparatus recited in claim 17, wherein the evaporated coolant from said evaporation chamber is provided to cool said at least one refrigerated component.

20. The cryostat apparatus recited in claim 17, wherein said evaporation chamber is in thermal communication with said at least one refrigerated component.

21. The cryostat apparatus recited in claim 10, wherein said sample chamber is a thermal environmental chamber.

22. A cryostat apparatus for regulating temperatures, the apparatus comprising:

a sample chamber;

a cryogenic cooler having at least one reduced-temperature stage;

a cryogenic cooler chamber containing the at least one reduced-temperature stage of the cryogenic cooler;

a main gas inlet conduit in fluid communication with said cryogenic cooler chamber;

a source of ambient temperature coolant gas fluidly connected to said main gas inlet conduit;

at least two siphoning ports comprising a first siphoning port and a second siphoning port, in fluid communication with the cryogenic cooler chamber, said first siphoning port being arranged to remove refrigerated coolant from said cryogenic cooler chamber in gas form and said second siphoning port being arranged to remove refrigerated coolant from said cryogenic cooler chamber in liquefied form;

a first coolant conduit and a separate second coolant conduit connecting said first and second siphoning ports, respectively, to said sample chamber, the first and second coolant conduits being separate and distinct from each other;

an ambient temperature flow control valve located external to said cooler chamber;

a counter-flow heat exchanger in fluid communication with said first coolant conduit and said ambient temperature flow control valve, and configured to warm said refrigerated coolant to ambient temperature where said refrigerated coolant passes through said ambient temperature flow control valve and thereafter cool said refrigerated coolant back down by the thermal action of the counter-flow heat exchanger and subsequently deliver said refrigerated coolant to said sample chamber;

said counter-flow heat exchanger and ambient temperature flow control valve being configured to control the flow of refrigerated coolant to said sample chamber.

* * * * *